US005314080A

United States Patent [19]

Wentworth

[11] Patent Number: 5,314,080

[45] Date of Patent: May 24, 1994

[54] ADJUSTABLE DISPLAY RACK

[76] Inventor: Richard W. Wentworth, 4924 S. Logan St., Lansing, Mich. 48910

[21] Appl. No.: 997,241

[22] Filed: Dec. 28, 1992

[51] Int. Cl.[5] ..... A47F 5/00

[52] U.S. Cl. ..... 211/181; 211/186

[58] Field of Search ..... 211/181, 186, 106, 189; 108/102

[56] References Cited

U.S. PATENT DOCUMENTS

| | | | |
|---|---|---|---|
| 492,359 | 2/1893 | Merker . | |
| 2,519,711 | 8/1950 | Sprechmann | 211/181 |
| 2,744,807 | 5/1956 | Bently . | |
| 2,850,172 | 9/1958 | Beckner | 211/181 X |
| 3,003,248 | 10/1961 | Wittie . | |
| 3,385,452 | 5/1968 | Dantino et al. . | |
| 3,385,453 | 5/1968 | Dantino et al. . | |
| 3,938,666 | 2/1976 | Castleberry . | |
| 4,033,538 | 7/1977 | Levy . | |
| 4,077,522 | 3/1978 | Trubiano . | |
| 4,313,544 | 2/1982 | Ashton | 211/181 |
| 4,655,352 | 4/1987 | Noyes et al. . | |
| 4,726,477 | 2/1988 | Martin . | |
| 5,096,074 | 3/1992 | Merl | 211/186 X |
| 5,170,897 | 12/1992 | Wentworth . | |

*Primary Examiner*—Alvin C. Chin-Shue
*Assistant Examiner*—Sarah A. Lechok
*Attorney, Agent, or Firm*—Lynn E. Cargill

[57] ABSTRACT

A multi-configurational display rack is disclosed which includes (a) a display rack body having two steps and (b) an angle rack attachable to the display rack body which transforms the display rack body from a two-step configuration to a sloped configuration. The angle rack may be horizontally hingeable into two portions so that, when hinged to an angle of less than 180°, the angle rack forms a step, thereby transforming the display rack body into a one-step configuration.

Also disclosed is a display rack having two height-adjustable steps. In one embodiment, the display rack includes (a) a frame member, (b) a first cross member, (c) a second cross member spaced apart from the first cross member, (d) a third cross member spaced apart from the second cross member so that the second cross member is positioned between the first and third cross members, (e) a top step rack component attachable to the first cross member at various heights and to the frame member at various heights, (f) a middle step rack component attachable to the top step rack component at various heights and to the second cross member at various heights, and (g) a flat rack component attachable to the second cross member and restable on the third cross member.

18 Claims, 4 Drawing Sheets

FIG 1
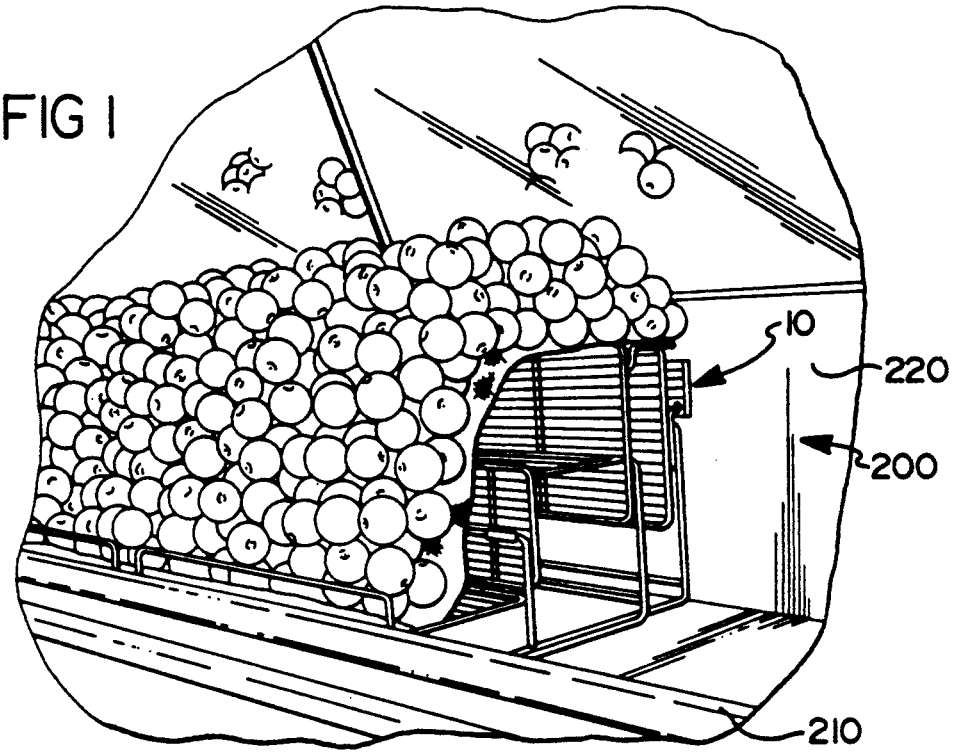
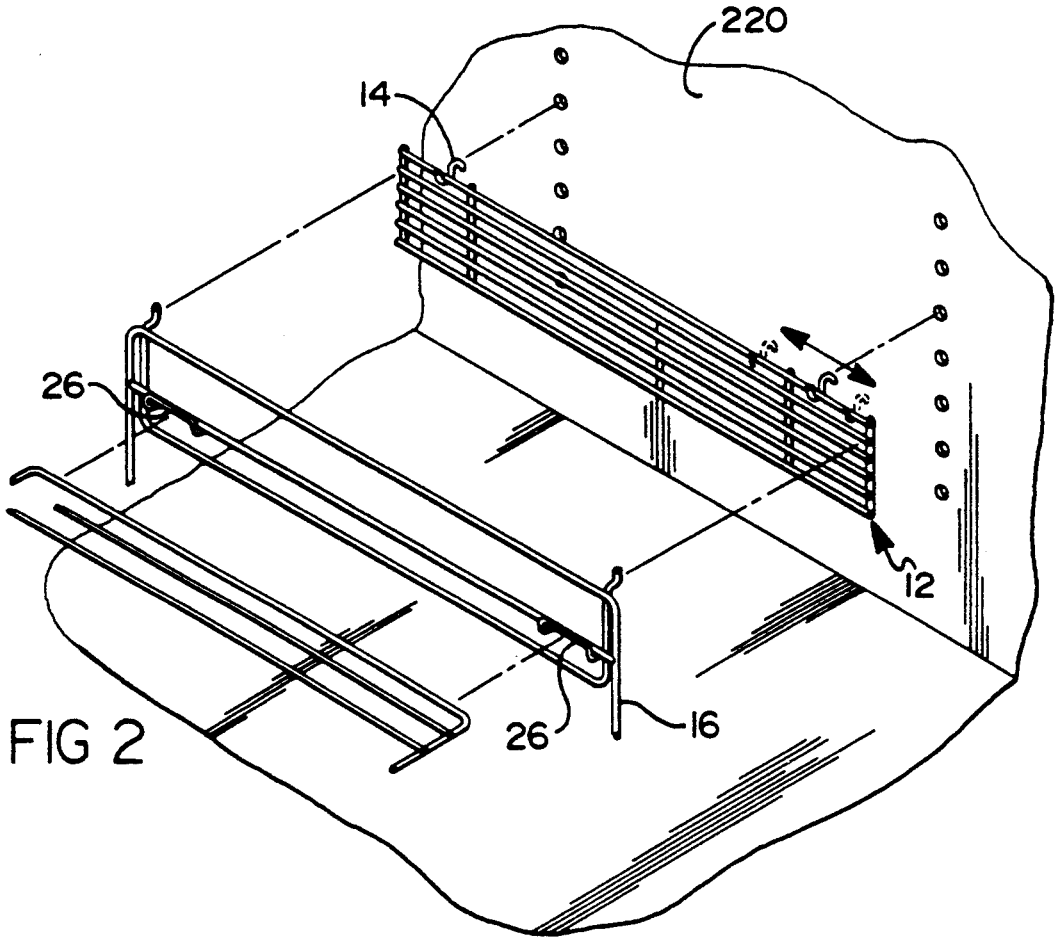
FIG 2

ADJUSTABLE DISPLAY RACK

TECHNICAL FIELD

This invention pertains to a multi-configurational display rack for displaying merchandise in a display counter.

BACKGROUND OF THE INVENTION

It has long been known to use various types of adjustable display racks in the retail industry, particularly in the grocery industry. Conventional adjustable racks are limited in their ability to adjust for height and depth to accommodate various size display counters and to effectively display varying amounts of merchandise. For example, when less product is to be displayed it is desirable to have a high profile rack in the display counter to achieve a look of fullness for effectively displaying the product. Generally, prior art adjustable shelves have had set height and depth adjustments requiring that the product, rather than the shelf, be rearranged to create an attractive display.

Also, the prior art generally does not provide a rack which is capable of being used in multiple configurations. Generally, conventional racks do not achieve both multiple step and multiple angle configurations with one rack assembly.

It would be advantageous to provide a display rack which is height and depth adjustable. It is desirable to have a single rack assembly which can be placed in multiple configurations including adjustable step and angle positions. Many attempts have been made to produce such a rack, but these attempts have fallen short in meeting the needs of the grocery industry. The following patents exemplify the display racks currently available.

One attempt to produce an adjustable display rack is disclosed in U.S. Pat. No. 4,077,522 issued Mar. 7, 1978 to Trubiano. This patent is for an adjustable display rack which comprises a base frame, a first articulated top shelf supported above the base frame and a second articulated top shelf supported above the first articulated top shelf and collapsible thereon. The first articulated top shelf has a hinge connection at a rear edge thereof. Supports are provided to maintain the articulated top shelves in a predetermined adjustable position above the base frame.

U.S. Pat. No. 3,385,453, issued May 28, 1968 to Dantino et al. discloses an adjustable display rack. The display rack has a first shelf section pivotally connected to the back of a frame. A second shelf section is connected to the first for telescoping and pivoting relative thereto. The first and second sections are mutually supporting to provide a substantially continuous shelf portion when the sections are telescoping. A third shelf section is pivotally connected to the second section and is supported at its forward end on the base. A support depends from one of the second and third shelf sections and is adapted to engage slots on the base for maintaining the shelf sections in different positions. The rack is adapted to fit a display case.

U.S. Pat. No. 3,385,452 issued May 28, 1968 to Dantino et al. teaches a store display rack having a first platform rotatably mounted and a second platform having optional slidable or rotational engagement with the first. The first and second platforms are mounted substantially uniplanar when overlapped and a third platform is rotatably engaged with the second. Support means are provided for maintaining the platforms fixed in relative position when permitting relative movement for varying the position thereof. The platforms can be mounted on a frame adapted to fit into a display rack, which frame can be broken down, or the supplemental bed can be mounted directly on the display rack.

It is apparent, upon review of the above referenced patents, that no single shelf design taught by these references can achieve all the features of the present invention, including height and depth adjustments and multiple step and angle configuration. A display rack, particularly one used in marketing grocery produce, desirably provides one rack capable of merchandising many different kinds of fruit, vegetables and other produce such as cider and fruit juice. The type of fruits and vegetables vary with the seasons, generally soft fruits being available in the summer and harder fruits and vegetables being available in the winter. It is necessary to stack less of the soft fruits to prevent bruising and product loss. Also, it is desirable to have a rack adjustable to a higher or lower profile depending on the amount of product available. When marketing juices or cider, it is advantageous to use many steps to stack the bottles. The width of the step is desirably variable depending on the width of the bottles. It is apparent then that a need exists in the industry for a rack capable of obtaining multiple step and angle configurations and which is height and depth adjustable.

Therefore, it is a primary object of the present invention to provide a multiple configuration display rack including variable step and angle adjustments.

It is yet another object of the present invention to provide a single rack assembly which may be height and depth adjustable to fit display counters of varying sizes.

SUMMARY OF THE INVENTION

In accordance with the preferred embodiment of the invention, these and other objects and advantages are addressed as follows.

One embodiment of the present invention is a multi-configurational display rack, which includes (a) a display rack body having two steps, (b) an angle rack attachable to the display rack body which transforms the display rack body from a two-step configuration to a sloped configuration, and (c) means for attaching the angle rack to the display rack body. The angle rack may be horizontally hingeable into two portions so that when hinged to an angle of less than 180°, the angle rack forms a step, thereby transforming the display rack body into a one-step configuration.

In another embodiment of the invention, a display rack is disclosed which has two height-adjustable steps. In one form, this display rack may have (a) a frame member, (b) a first cross member, (c) a second cross member spaced apart from the first cross member, (d) a third cross member spaced apart from the second cross member so that the second cross member is positioned between the first and third cross members, (e) a top step rack component having two vertically extending side portions and a horizontally extending top portion connecting the vertically extending side portions, the top step rack component being attachable to the first cross member at various heights and to the frame member at various heights, (f) a middle step rack component having a top section and a vertical section and being attachable to the top step rack component at various heights and to the second cross member at various heights, and (g) a flat rack component attachable to the second cross member and restable on the third cross member.

In a specific embodiment, the present invention is a multi-configurational display rack for displaying merchandise in a display counter, where the display counter has a front area and a back wall. The multi-configurational display rack is attached to the back wall of the display counter by a mounting support which hooks into holes formed in the back wall. A telescoping base frame unit provides a framework upon which other components of the display rack are mounted. The base frame unit includes first and second telescoping frame members which provide the depth adjustment for the multi-configurational display rack. The first telescoping frame member is attachable to the mounting support, whereby the height of the display rack is adjustable due to the location of the base frame unit mounted on the mounting support. The height of the base frame unit may be adjusted by attaching the base frame at a lower or higher position on the mounting support.

The first telescoping frame member of the base frame unit includes a rectangular portion and two L-shaped leg members which extend from opposite sides of the rectangle.

The second telescoping frame member of the base frame unit includes a forward section and a back section and is slidably connected to the first telescoping frame member. The second telescoping frame member includes multiple spaced apart cross members of graduated heights. Preferably, there are three cross members. Each cross member has a rectangular portion and two downwardly extending leg members integral with opposite sides of the rectangular portion. A first cross member is adjacent to the first telescoping frame member. A second cross member is shorter than and spaced apart from the first. If included, the third cross member is the shortest and is located in front of the second cross member. Two telescoping tubular members are located on either side of the bottom of the second frame member. The downwardly extending legs of the cross members are attached to the tubular members. The bottom of each of the L-shaped legs of the first frame member are insertable into each of the tubular members, thereby providing a slidable telescoping relationship between the first and second frame members. Therefore, this telescoping design provides a depth adjustable base frame unit.

It is also contemplated for the multi-configurational display rack to also include various other components which may include a two-piece, top step rack component which is adjustable for both height and depth. For this embodiment, each of the two pieces include a horizontally extending portion and a vertically extending portion integral therewith. The first and second pieces fit together by overlapping the horizontally extending portions so that the horizontally extending portions are slidably connected to each other. One of the vertically extending portions rests on a bracket located on the first telescoping frame member of the base frame unit. The other vertically extending portion rests on a bracket located on the first cross member.

The multi-configurational display rack can also include a middle step rack component having a horizontal top section and a vertical section integral with and perpendicular to said top section. The contemplated middle step rack attaches to the top step rack and to the base frame unit and is adjustable in height.

Depending upon the desired application, the display rack may also have a rectangular flat rack component which attaches to the base frame unit in front of and below the middle step rack.

The multi-configurational rack may further include an adjustable angle rack component having four interconnected rectangular shelves. The shelves can be positioned with respect to each other in a uniplanar or angular configuration. The first shelf attaches to the top step rack and the fourth shelf attaches to the rectangular flat rack to hold the angle rack in position.

Furthermore, the multi-configurational display rack may include a half step rack which has a horizontal top portion and a vertical portion integral with and extending perpendicular to the top portion. The half step rack would also include a securement means for securing the rack to at least one other rack. The rack may be positioned on the rectangular flat rack or on the middle step rack to provide additional risers on the multi-configurational rack.

Finally, the multi-configurational display rack may include a product stop to prevent product from rolling off the display. Preferably, the stop is an elongated bar attachable to the base frame unit, positioned in front of and slightly above the rectangular flat rack.

BRIEF DESCRIPTION OF THE DRAWINGS

The nature and extent of the present invention will be clear from the following detailed description of the particular embodiments thereof, taken in conjunction with the appendant drawings, in which:

FIG. 1 is a perspective front view of one embodiment of the multi-configurational display rack of the invention;

FIG. 2 is an exploded view of the mounting support and base frame unit of the display rack shown in FIG. 1;

DETAILED DESCRIPTION OF THE INVENTION

Figure 3:
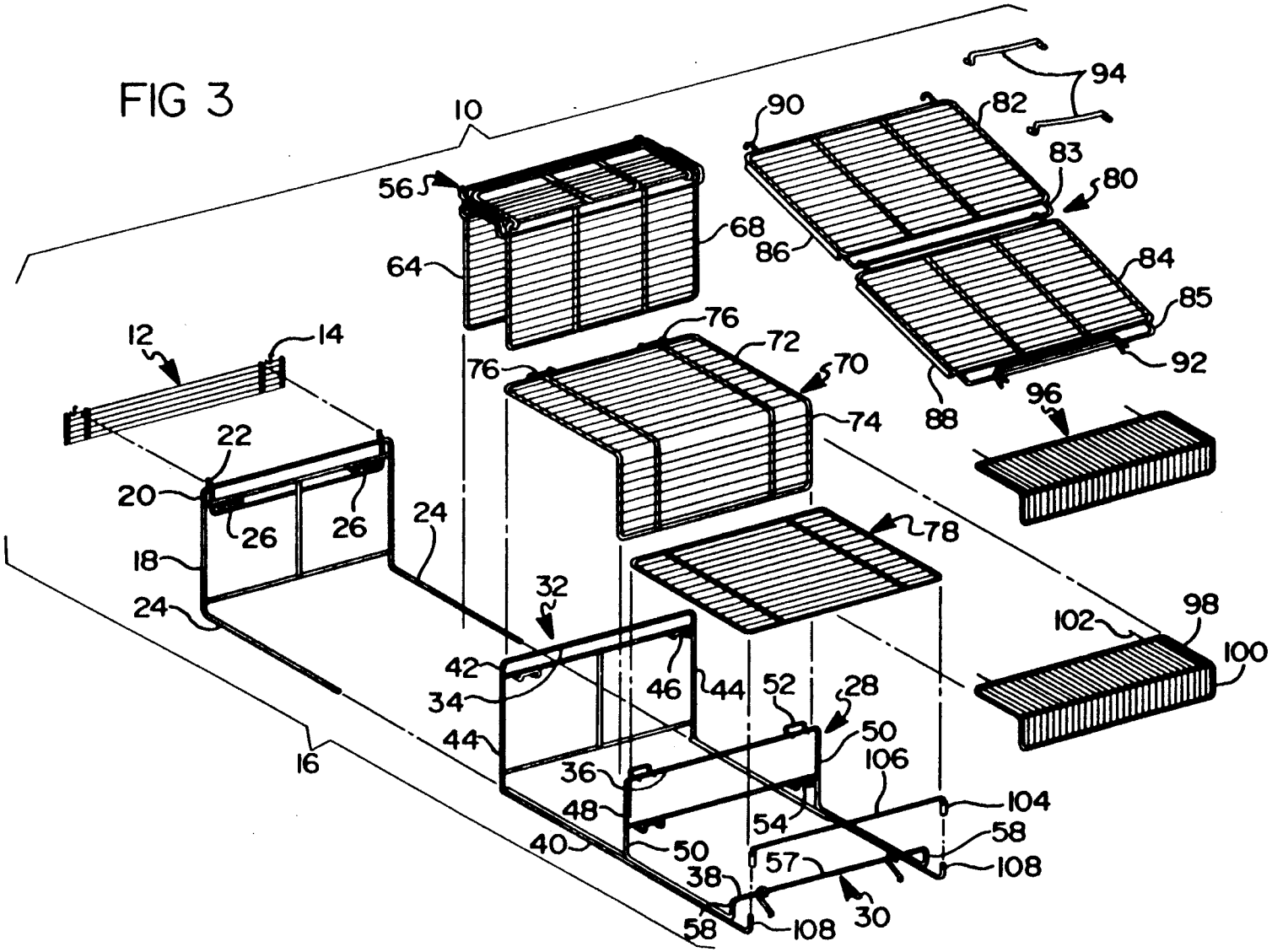
FIG. 3 is an exploded view of the multi-configurational display rack shown in FIG. 1.

With reference to FIG. 1 of the drawings, a multi-configurational display rack for displaying merchandise in a display counter is generally indicated by reference numeral 10 and is mounted in a display counter generally indicated by 200 having a front restraining lip 210 and a back wall 220. Shown is a display of grapefruits in a grocery store display. As will be seen later, the rack can have many configurations.

Looking now to FIG. 2, the display rack generally comprises a mounting support 12, having a generally rectangular configuration. The mounting support 12 may have cross wires or may be of a grid design to accommodate the attachment of additional racks. The rack may be made of metal, wood, plastic or any other suitable material. It would be preferable for the material to be able to withstand moisture and acids from the food displayed thereon. Especially useful is vinyl or plastic coated metal wire for construction. The varying heights of cross wires or grids allows other pieces to be attached at a higher or lower position to provide height adjustability of the multi-configurational display rack. This allows the display rack to accommodate display counters of varying heights. Attachment means 14 attaches the mounting support 12 to the back wall of the display counter 220.

Referring now to FIG. 3, the preferred embodiment of the multi-configurational rack of the present invention is shown in an exploded view. As will be more clearly described later, my display rack can be adjusted to take the place of many racks. It can be sloped, one-step, two-steps, or multi-stepped. The type and size of the foods or containers being displayed will dictate the particular configuration of the rack to most effectively and artistically display the food. For example, even though conventional racks had b 8" deep shelves, common food shipping trays are now 12" deep. My rack can accommodate such trays and food cases. In addition, it is now common practice to sell salad dressings and gallons of apple cider in the produce section of grocery stores. The adjustability of the number of steps, as well as their respective height adjustments, makes this rack ideal for modern grocery displays. The following is a basic description of the individual components of the display rack and how the components fit together.

As shown in FIG. 3, the preferred embodiment of the multi-configurational display rack of the present invention includes a base frame unit 16 having first and second telescoping frame members, 18 and 28 respectively. Arranged on the base frame unit 16 in the area nearest the back wall of the display counter is a top step rack component 56. In front of the top step rack 56 is a middle step rack component 70. In front and below the middle step rack 70 is a rectangular flat rack component 78 which rests on the base frame unit 16. The multi-configurational display rack also includes an adjustable angle rack 80 which can be used with or without the middle rack 70 in place. The angle rack 80 attaches to the top step rack 56 and the rectangular flat rack 78.

Figure 6:
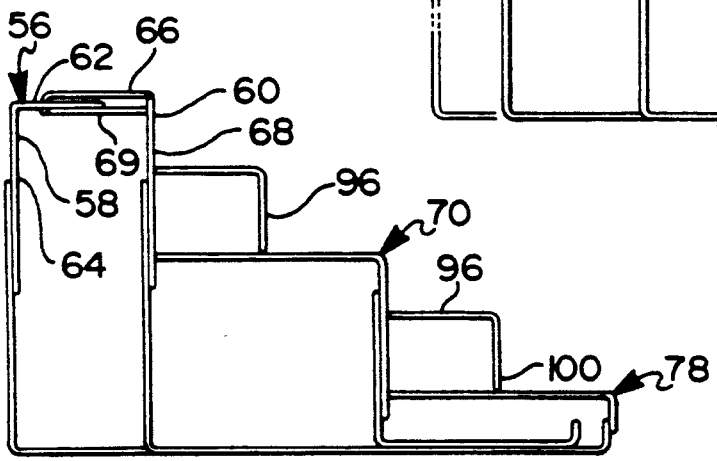
FIG. 6 is a side view of the multi-configurational rack of FIG. 1 in the multi-step configuration with half step racks in place.

As shown in FIGS. 3 and 6, an additional component of the multi-configurational display rack can be one or both of the half-step racks 96 for placement on the rectangular flat rack 78 or on the middle step rack 70. The half-step rack 96 is used with smaller square containers such as pints and quarts of fruits or bottled beverages. Finally, as shown in FIG. 3, the multi-configurational rack may include a removable product stop 104 which includes an elongated bar 106 mateable with projections 108 on the base frame unit 16. This product stop prevents fruit, vegetables or other items from rolling or sliding off the display rack. A similar stop may be incorporated on any of the shelves.

Referring now to the individual components of the multi-configurational display rack, the following will provide a complete description of each component. As described hereinabove, and shown in FIGS. 2 and 3, the mounting support 12 has a generally rectangular configuration and includes cross wires or a grid for removably attaching other racks to the support at different heights. The mounting support 12 has an attachment means 14 for mounting the support to the back wall of a display counter. Preferably the attachment means 14 is a hook-type means insertable in holes in the back wall of a display counter. The point of attachment for the mounting support on the back wall is variable depending on the location of the holes in the back wall. Any attachment means such as clips, S-shaped or square hooks or other suitable means may be used to attach the support to the back wall of the display counter.

As described above with reference to the preferred embodiment shown in FIG. 3, attached to the mounting support 12 is a base frame unit 16 having first and second telescoping frame members 18 and 28 respectively. The first telescoping frame member 18 is attachable to the mounting support 12 and includes a generally rectangular portion 20 and two L-shaped leg members 24 integral with and extending downwardly from opposite sides of the rectangular portion. The rectangular portion 20 has upwardly extending prongs 22 on either side of the rectangle which fasten to the mounting support 12. Preferably, each prong 22 is L-shaped and is insertable through cross wires of the mounting support 12 so that the foot of the "L" rests on a cross wire of the support, thereby attaching the base frame unit 16 to the mounting support 12. The first telescoping frame member also includes a pair of forward extending brackets 26 located at the top of the rectangular portion 20. These brackets 26 support other racks on the base frame unit.

Referring again to FIG. 3, the base frame unit 16 also includes a second telescoping frame member 28 which is slidably connected to the first frame member 18. The second frame member 28 has a forward section 30 and a back section 32 wherein the back section is adjacent to the first frame member 18. The second frame member 28 includes first, second and third spaced apart cross members designated at 34, 36 and 38 respectively.

The first cross member 34 has a rectangular portion 42 and two downwardly extending leg members 44 integral with opposite sides of the rectangular portion. The second cross member 36 has a rectangular portion 48 and two downwardly extending leg members 50 integral with opposite sides of the rectangular portion. The third cross member 38 has a cross bar 57 and two downwardly extending leg members 58 integral with opposite sides of the rectangular portion. The spaced apart cross members are of graduated heights. The first cross member 34 is adjacent to the first telescoping frame member 18. The second cross member 36 is shorter than and spaced apart from the first cross member 34. The third cross member 38 is the shortest and is positioned in front of the second cross member 36.

As shown in FIG. 3, the second telescoping frame member 28 also includes two tubular members 40 located on either side of the bottom of the second telescoping frame member. The downwardly extending legs 44, 50 and 58 of each cross member are attached to the tubular members 40. The bottom of the L-shaped legs 24 of the first frame member telescope into the two tubular members 40, by insertion of the L-shaped leg into the tubular member. A slidable relationship is thereby formed between the first and second frame members 18 and 28. This allows the multi-configurational display rack to be adjusted for display cases of various depths. Most often, the display cases range in depth from 32 inches to 37 inches. The telescoping nature of the base frame unit allows adjustment for these measurements or to fit any other display case.

Referring again to FIG. 3, the first and second spaced apart cross members 34 and 36 located on the second telescoping frame member 28 also include support brackets 46 and 54, respectively, for holding the various racks in a variety of configurations. The first cross member 36 has a set of support brackets 46 located near the top of the rectangular portion 42 of the second frame member 28. The second cross member 36 includes two sets of support brackets 52 and 54. The first set of brackets 52 are located near .the top of the rectangular portion 48 of the cross member and are oriented toward the back of the second frame member 28. The second set of brackets 54 are located near the bottom of the rectangular portion 48 and are oriented toward the front of the second frame member 28.

Looking now to FIG. 6, the top step rack 56 includes two pieces 58 and 60. The first piece 58 includes a horizontally extending portion 62 and a vertically extending portion 64 which is perpendicular to and hingedly connected to the horizontal portion. The second piece 60 includes a horizontally extending portion 66, and a vertical portion 68, the horizontally extending portion further including an underside having a three sided ledge 69, formed thereon. The three sided ledge 69 receives the horizontally extending portion of the first piece 62 such that the horizontally extending portion is slidably connected to and telescopes into the horizontally extending portion of the second piece 66. The slidable, telescoping connection of horizontally extending portions 62 and 66 provides depth adjustability of the top step rack. This depth adjustability is necessary to accommodate the variable depth adjustment of the base frame member. The vertically extending portions 64 and 68 are parallel to each other and are adjustably attachable to the base frame unit. As shown in FIG. 3, vertical portion 64 of the top step rack attaches to brackets 26 on the first telescoping frame member 18 and vertical portion 68 attaches to brackets 46 on the first cross member.

Preferably, the top step rack 56 includes cross wires or a grid configuration. The cross wires preferably run in the direction of the width of the display rack. By placing the various cross wires on the brackets 26 and 46 the top step rack can be adjusted to a variety of heights.

Figure 5:
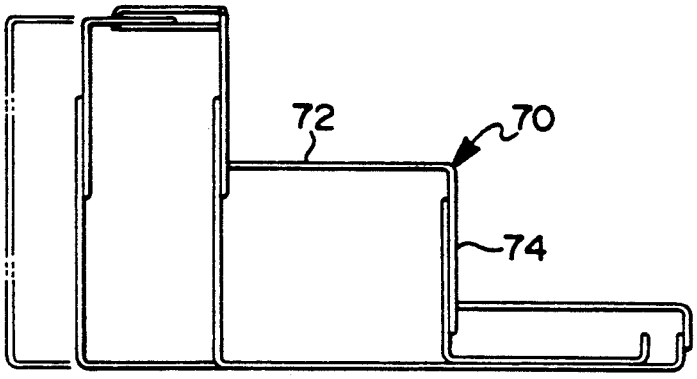
FIG. 5 is a side view of the multi-configurational display rack of FIG. 1 in the two-step configuration.

As shown in FIG. 5, the middle step rack 70 has a horizontal top section 72 and a vertical section 74 integral with and extending perpendicular to said top section. As shown in FIG. 3, the top section 72 includes a set of brackets 76 for attaching the middle step rack to the top step rack 56. The vertical section 74 of the middle step rack rests on brackets 52 of the second cross member. The middle step rack may be of a cross wire or grid configuration. In the preferred embodiment the middle step rack is of a cross wire configuration. The cross wires preferably run in the direction of the width of the display rack. The height of the middle step rack 70 is adjusted by placing the cross wires of middle step rack component 70 on brackets 52 at the desired height and by placing brackets 76 of middle step rack component 70 on the cross wire of choice of top step rack component 56.

The rectangular flat rack component 78 preferably includes cross wires or is of a grid configuration. The flat rack attaches to the brackets 5 on the second cross member and rests on the third cross member 38.

Figure 7:
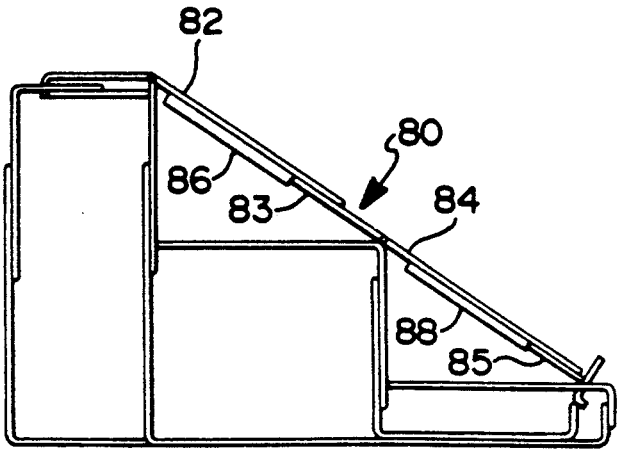
FIG. 7 is a side view of the multi-configurational display rack of FIG. 1 with the angle rack in a sloping configuration.

As shown in FIG. 7, the adjustable angle rack component 80 includes four interconnecting shelves 82, 83, 84 and 85, which can be positioned with respect to each other in a uniplanar or angular configuration. The four shelves are of a generally rectangular configuration. As shown in FIG. 3, a first shelf 82 has a top portion and an underside portion, said top portion having two hook members 90, integral therewith for attachment to the top step rack 56. Referring again to FIG. 7, ledges 86 are located on either side of the first shelf 82 on the under side portion thereof. A second shelf 83 is slidably connected with and telescopes into ledges 86 located on the first shelf 82. The second shelf 83 is hingedly connected to a third shelf 84. The third shelf 84 has a top portion and an underside portion with ledges 88 located on either side of the under side portion. A fourth rack 85 slidably connects with and telescopes into the ledges 88 on the third rack 84. As shown in FIG. 3, the fourth rack 85 also includes prong-like projections 92 extending therefrom for securing the fourth rack to the rectangular flat rack 78. The adjustable angle rack also includes a clip-type securement means 94 for securing together racks 82 and 83 in a telescoping or overlapping position and for securing together racks 84 and 85 in a telescoping or overlapping position.

As shown in FIG. 7, the angle rack component may be positioned so that shelves 82, 83, 84 and 85 are in a uniplanar relationship with respect to each other and are placed over the top step rack and the rectangular flat rack.

Figure 4:
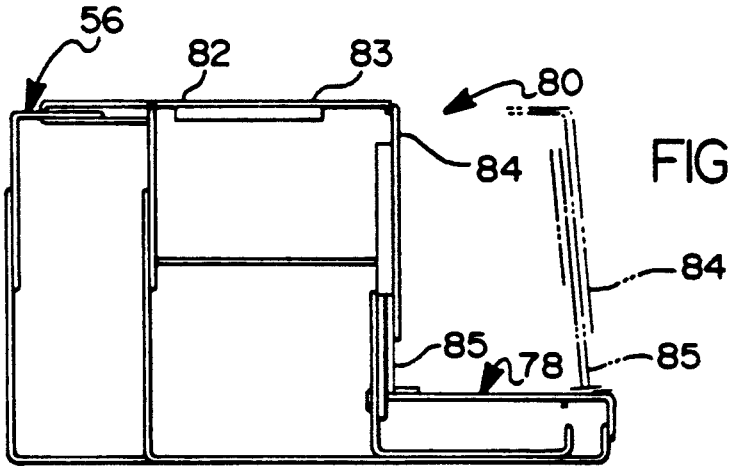
FIG. 4 is a side view of the multi-configurational display rack of FIG. 1 with the angle rack in the one-step configuration.

Alternatively, as shown in FIG. 4, the angle rack component may be positioned so that the first and second shelves 82 and 83 telescope into one another and form an angle greater than or equal to 90 degrees with shelves 84 and 85 which are also telescoped together. In this configuration, shelf 82 attaches to the top step rack 56 and shelf 85 is positioned on the rectangular flat rack 78 by means of the prong-like projections 92 (see FIG. 3) to the form the angle desired. By the attachment of the angle rack 80 to the top step rack 56 the angle rack is adjustable for height. When the top step rack 56 is raised, shelves of the angle rack 82, 83, 84 and 85 telescope apart and the angle rack expands to accommodate the height of the top step rack. The angle is increased or decreased by moving shelf 85 forward or backward along the rectangular flat rack. The angle rack may be placed over the middle step rack or used without the middle step rack.

As shown in FIGS. 3 and 6, the multi-configurational display rack also may include at least one half-step rack component 96 having a horizontal top portion 98 and a vertical portion 100 integral with and extending perpendicular to said top portion. A securement means such as a prong 102 extending horizontally from the horizontal top portion secures the half-step rack to at least one other rack. The rack may be positioned on the rectangular flat rack 78 or the middle step rack 70 to provide additional steps for stacking produce or other merchandise in small containers such as pints or quarts of berries or containers of varying sizes for juice, cider and other beverages.

As shown in FIG. 3, the multi-configurational display rack also includes a removable product stop 104 which includes an elongated bar 106 with projections extending from either end thereof mateable with projections 108 extending from each of the two telescoping tubular members 40 at a position in front of the third cross member 38.

Figure 8:
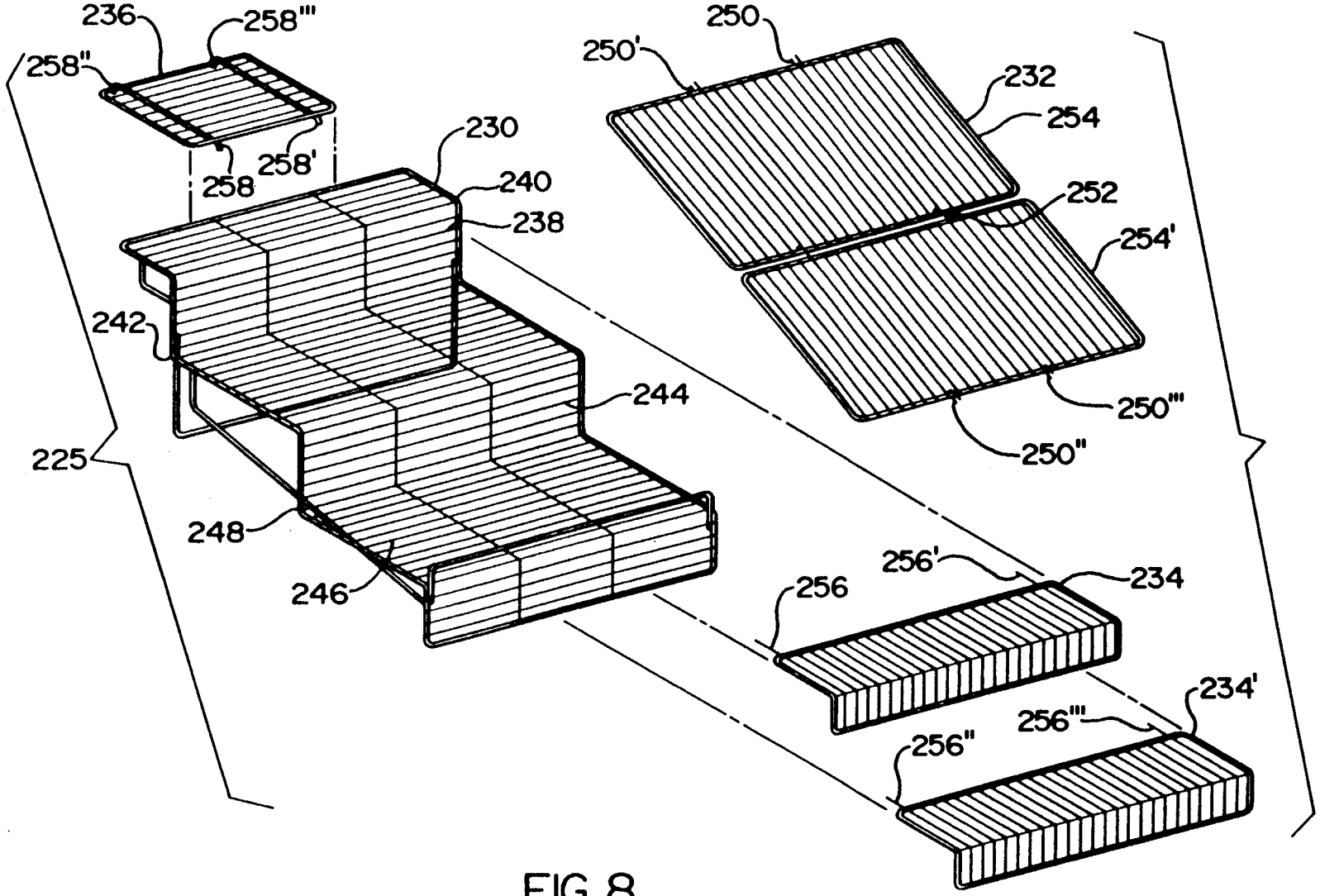
FIG. 8 is an exploded view of another embodiment of the multi-configurational display rack of the invention.

FIG. 8 shows an exploded view of another display rack 225 of the invention which is especially suitable for refrigerated island case displays. Display rack 225 includes display rack body 230, angle rack 232, half-step racks 234 and 234', and back-to-back rack connector 236. Display rack body 230 is a one-piece construction, however, it may be a multi-piece construction. Display rack body 230 includes (i) top step 238 having edge 240 and corner 242 and (ii) bottom step 244 having foot 246 and corner 248. Like all steps, the top and bottom steps of display rack body 230 each have a horizontal portion and a vertical portion. A "corner" of a step is that portion of a step at which the vertical portion of a step meets the horizontal portion of the next descending step or floor, if the step being considered is a bottom step. Foot 246 is a horizontal extension extending from the vertical portion of the bottom step, step 244. Display rack body 230 is formed of cross wires running in the direction of the width of the display rack.

Angle rack 232 has attachment means 250, 250', 250'', and 250''' and is attachable to display rack body 230 at top step 238 and foot 246 of bottom step 244. Preferably, angle rack 232 is attachable to top step 238 at edge 240. Angle rack 232 has hinge 252 so that angle rack 232 is horizontally hingeable into two portions 254 and 254'. When angle rack 232 is attached to display body 230 and is hinged to an angle of less than 180°, the angle racks forms a step, thereby transforming display rack body 230 into a one-step configuration, similar to the configuration shown in FIG. 4. When angle rack 232 is left planar and attached to display rack body 230, angle rack 232 transforms display rack body 230 from a two-step configuration to a slope configuration similar to that shown in FIG. 7. Although angle rack 232 is shown as being a generally two-piece construction, it may instead be of construction similar to the angle rack 80 shown in FIGS. 3, 4, and 7, wherein each hingeable portion has telescoping shelves, so that each portion is adjustable in length.

Half-step racks 234 and 234' have securement means 256, 256', 256'', and 256''' for securing the half-step racks to display rack body 230. Half-step rack 234 may be placed at corner 242 of top step 238, and half-step rack 234' may be placed at corner 248 of bottom step 244 of display rack body 230. When both half-step racks are in place on display rack body 230, display rack body 230 is transformed from a two-step configuration to a four-step configuration, similar to that shown in FIG. 6. If only one half-step rack were in place, display rack body 230 would have a three-step configuration.

Back-to-back rack connector 236 is employed especially in refrigerated island cases where display racks such as display rack 225 are placed on each side of a refrigerated island case, back-to-back. Two back-to-back rack connectors are placed side-by-side to bridge two display racks together. Back-to-back rack connector 236 has attachment means 258, 258', 258'', and 258''' to enable attachment to the top steps of the display racks.

To use display rack 225 on a refrigerated island case, the island case is first prepared by installing, in the island case, the flat racks which accompany the island case when purchased. The flat racks are installed on each side of the island case at a slight incline (approximately a 13° angle). The display rack bodies are then placed on the flat racks. The rear of display rack body 230 should be above the island case superstructure (the highest level of the island case), and the front of display rack body 230 should be within the island case. The flat racks should be adjusted in angle position until the steps of the display rack bodies are level. Attach back-to-back rack connectors 236 to top step 238 of each display rack to bridge the gap over the superstructure of the island case. Two back-to-back rack connectors 236 are required for every two back-to-back display racks. The display racks are now ready to display merchandise. Optionally, angle rack 232 may be placed on each display rack body 230 to transform display rack body 230 from a two-step configuration to a sloped configuration or a one-step configuration as described hereinabove. Alternatively, half-step racks 234 and 234' may be placed on display rack body 230 to transform the display rack body from a two-step configuration to a four-step configuration.

The above described multi-configurational display rack may be manufactured from materials such as steel and plastic. Preferably the various racks have cross wire configurations, although a grid configuration can also be utilized.

The above described display rack is clearly novel in its design which allows for height adjustment of both the complete tiered display rack and the individual rack components on the display rack. Further, the design of the base frame allows the display rack to be adjusted to fit display cases of various depths. As described herein, the top step rack and angle rack may also be adjusted to various widths to accommodate the product to be displayed on the racks. Also, the display rack provides for adjustment to both step and angle configurations.

While the best mode for constructing the invention has been described herein in detail, those familiar with the art to which this invention relates will recognize various alternative ways of carrying out the invention as defined by the following claims. Accordingly, the scope of my invention is to be limited only by the following claims.

What is claimed is:

1. A multi-configurational display rack, comprising:
(a) a display rack body having two steps,
(b) an angle rack attachable to the display rack body to transform the display rack body from a two-step configuration to a sloped configuration, and
(c) means for attaching the angle rack to the display rack body.

2. The multi-configurational display rack of claim 1, wherein the display rack body is of a one-piece construction.

3. The multi-configurational display rack of claim 1, wherein the display rack body is formed of cross wires running in the direction of the width of the display rack body.

4. The multi-configurational display rack of claim 1, wherein the display rack body has a top step and a bottom step and the angle rack is attachable to the display rack body at the top step.

5. The multi-configurational display rack of claim 1, wherein the display rack body has a top step and a bottom step and further comprises a half-step shelf placed on the display rack body at the corner of one of the steps, thereby transforming the display rack body from a two-step configuration to a configuration having at least three steps.

6. The multi-configurational display rack of claim 1, wherein the height of each step is adjustable.

7. The multi-configurational display rack of claim 1, wherein the display rack body comprises:
(a) first and second spaced apart cross members,
(b) a top step rack component attachable to the first spaced apart cross member at various heights, and (c) a middle step rack component attachable to the top step rack component and the second spaced apart cross member at various heights.

8. The multi-configurational display rack of claim 1, wherein the angle rack is horizontally hingeable into two portions so that when hinged to an angle of less than 180°, the angle rack forms a step, thereby transforming the display rack body into a one-step configuration.

9. The multi-configurational display rack of claim 8, wherein each portion of the angle rack has telescoping shelves, so that each portion of the angle rack is adjustable in length.

10. The multi-configurational display rack of claim 1, wherein the depth of the top step is adjustable.

11. The multi-configurational display rack of claim 10, wherein the top step of the display rack body comprises a top step rack component having two pieces, each piece having a horizontally extending top portion, the horizontally extending top portions being slidably connected to allow depth-wise telescoping of the horizontally extending top portions, thereby allowing for the adjustment of the depth of the top step.

12. A multi-configurational display rack, comprising:

(a) a display rack body having a top step and a bottom step having a foot, (b) an angle rack attachable to the display rack body at the top step and at the foot of the bottom step to transform the display rack body from a two-step configuration to a sloped configuration, the angle rack being horizontally hingeable into two portions so that when hinged to an angle of less than 180°, the angle rack forms a step, thereby transforming the display rack body into a one-step configuration, and (c) means for attaching the angle rack to the display rack body.

13. A display rack having two height-adjustable steps, comprising:

(a) a first cross member, (b) a second cross member spaced apart from the first cross member, (c) a top step rack component attachable to the first cross member at various heights, and (d) a middle step rack component attachable to the top step rack component and the second cross member at various heights.

14. The display rack of claim 11, wherein the top step rack component and the middle step rack component are formed of cross wires running in the direction of the width of the display rack.

15. The display rack of claim 11, further comprising:

(e) a frame member to which the top step rack component is attachable at various heights, (f) a third cross member spaced apart from the second cross member so that the second cross member is positioned between the first and third cross members, (g) a flat rack component attachable to the second cross member and restable on the third cross member, and wherein the top step rack component includes two vertically extending side portions and a horizontally extending top portion connecting the vertically extending side portions and the middle step rack component includes a top section and a vertical section.

16. A display rack having two height-adjustable steps, comprising:

(a) a frame member, (b) a first cross member, (c) a second cross member spaced apart from the first cross member, (d) a third cross member spaced apart from the second cross member so that the second cross member is positioned between the first and third cross members, (e) a top step rack component having two vertically extending side portions and a horizontally extending top portion connecting the vertically extending side portions, the top step rack component being attachable to the first cross member at various heights and to the frame member at various heights, (f) a middle step rack component having a top section and a vertical section and being attachable to the top step rack component at various heights and to the second cross member at various heights, and (g) a flat rack component attachable to the second cross member and restable on the third cross member.

17. A multi-configurational display rack, comprising:

(a) a display rack body having two steps, each step having a corner, (b) an angle rack attachable to the display rack body to transform the display rack body from a two-step configuration to a sloped configuration, and (c) means for attaching the angle rack to the display rack body.

18. The multi-configurational display rack of claim 1, wherein the display rack body has a top step and a bottom step having a foot and the angle rack is attachable to the display rack body at the top step and at the foot of the bottom step.

* * * * *